United States Patent [19]

Generoux

[11] 4,128,136

[45] Dec. 5, 1978

[54] DRILL BIT

[75] Inventor: Robert E. Generoux, North Bay, Canada

[73] Assignee: Lamage Limited, North Bay, Canada

[21] Appl. No.: 859,072

[22] Filed: Dec. 9, 1977

[51] Int. Cl.[2] ..... E21B 9/36

[52] U.S. Cl. ..... 175/330; 175/379; 175/410; 175/403; 51/309 R

[58] Field of Search ..... 175/329, 330, 379, 410, 175/409, 413, 403–405; 125/20, 30 R, 30 WD; 51/309 R, 206 R

[56] References Cited

U.S. PATENT DOCUMENTS

| | | | |
|---|---|---|---|
| 2,182,562 | 12/1939 | Koebel | 175/330 |
| 2,506,388 | 5/1950 | Ross | 175/229 X |
| 2,511,991 | 6/1950 | Nussbaum | 175/330 |
| 2,966,949 | 1/1961 | Wepsala, Jr. | 175/329 |
| 3,049,843 | 8/1962 | Christensen | 125/20 X |
| 3,106,973 | 10/1963 | Christensen | 175/413 X |
| 3,127,715 | 4/1964 | Christensen | 175/330 X |
| 3,203,774 | 8/1965 | Pratt | 51/309 X |
| 3,494,359 | 2/1970 | Smith et al. | 175/379 X |

*Primary Examiner*—Ernest R. Purser

*Assistant Examiner*—Richard E. Favreau

*Attorney, Agent, or Firm*—Rogers, Bereskin & Parr

[57] ABSTRACT

A diamond drill coring bit having an annular crown and inner and outer concentric side surfaces. The crown is formed from a number of radially extending composite segments spaced apart circumferentially by a circumferential spacer material, all integrally bonded together. Each composite segment consists of a number of diamond impregnated segments spaced radially from each other by a radial spacer material. The diamond impregnated segments have greater abrasion resistance than that of the radial spacer material such that the radial spacer material will wear at a controlled rate greater than that of the diamond impregnated segments. The radial spacer material has greater abrasion resistance than that of the circumferential spacer material such that the circumferential spacer material will wear at a controlled rate greater than that of the radial spacer material but not so great as to prematurely expose the composite segments. The circumferential spacer material has good thermal conductivity to conduct heat from the composite segments, and substantial ductility to absorb drilling shocks.

6 Claims, 8 Drawing Figures

DRILL BIT

This invention relates to diamond drill coring bits.

Diamond coring bits are commonly used for exploration core drilling and generally fall into one of two categories. In the first category, consisting of surface set diamond bits, whole diamonds are set into a drilling face of the bit. So long as the diamonds are sharp, such bits are capable of operating at a very high drill penetration rates and are extremely effective. Unfortunately, the diamonds are relatively large and are therefore costly. In addition, the diamonds become dull or polished during use so that the effectiveness of the drill bit deteriorates fairly rapidly during use. When the diamonds become dull, the bit must be removed and replaced. Considerable time is lost in this procedure, and in addition, while the diamonds from the removed bit may be recovered and reset, the cost involved in maintaining an inventory of surface set bits, and of diamonds of various grades and sizes, is substantial.

In the second category of diamond drill bits, numerous small diamonds are set in a matrix body. Commonly the diamonds are uniformly dispersed throughout the body of the matrix, but the diamonds can also be concentrated in radially spaced rings, to create a ringing pattern, i.e. to create ribs in the material being drilled. Examples of such bits are shown in U.S. Pat. Nos. 3,106,973 and 3,127,715. The impregnated diamond bits have the advantage that they are consumable in use, so the bit can be used to drill through a considerable footage without being removed from the drill string. Unfortunately, the tracking and flushing characteristics of such bits and their penetration rates have not been as good as those of a new surface set bit. Therefore, surface set bits continue to be widely used, despite their greater cost of considerable inconvenience.

The present invention provides an impregnated diamond drill core bit which, in tests which have been conducted, have been found capable of drilling at high penetration rates, with good tracking and flushing, through substantial footages before replacement is needed. To this end the invention provides a diamond drill core bit comprising:

a. an annular bit body having an end, b. an annular crown integrally secured to said end and having a cutting face and inner and outer concentric side surfaces, said crown comprising:

1. a plurality of composite segments each extending generally radially between said inner and outer side surfaces, said composite segments being spaced circumferentially from each other and being elongated depthwise of the crown and extending to said cutting face to wear with said cutting face in use, 2. a cicumferential spacer material integrally adhered to said composite segments and extending circumferentially between said composite segments to space the latter circumferentially apart, said circumferential spacer material also extending generally radially between said inner and outer surfaces and being elongated depthwise of the crown and extending to said cutting face to wear with said cutting face in use, c. each composite segment comprising a plurality of diamond impregnated segments separated radially from each other by a radial spacer material, a diamond impregnated segment being located at each of said inner and outer side surfaces, said diamond impregnated segments and said radial spacer material therebetween all extending to said cutting face, d. said diamond impregnated segments having greater abrasion resistance than that of said radial spacer material such that said radial spacer material will wear at a controlled rate which is greater than that of said diamond impregnated segments but not so great as to prematurely expose said diamond impregnated segments, e. said radial spacer material having greater abrasion resistance than that of said circumferential spacer material such that said circumferential spacer material will wear at a controlled rate which is greater than that of said radial spacer material but not so great as to prematurely expose said composite segments, f. said circumferential spacer material having substantial thermal conductivity and ductility.

Further objects and advantages of the invention will appear from the following description, taken together with the accompanying drawings, in which.

Figure 1:
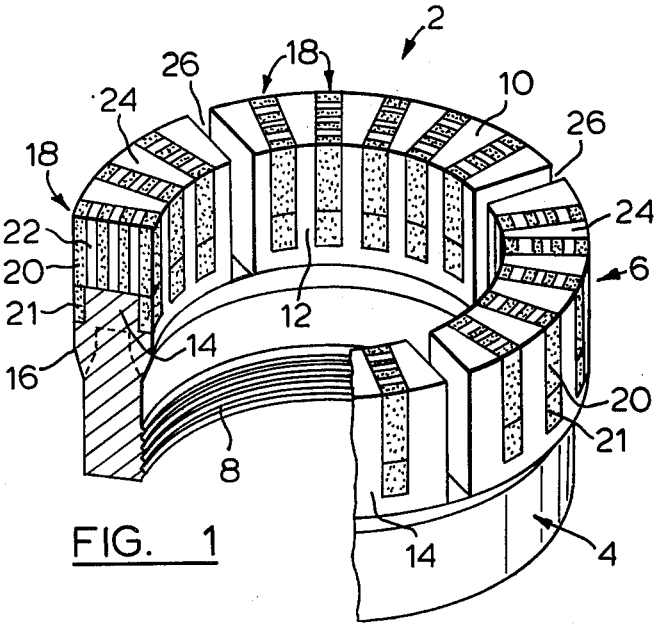
FIG. 1 is a perspective view, partly broken away, showing a bit according to the invention.

Reference is first made to FIG. 1, which shows a drill bit 2 according to the invention. The bit 2 comprises a shank 4 and a crown 6. The shank 4 is normally formed of steel and is commonly threaded as indicated at 8, for attachment to a drill string. The crown 6 has a cutting face 10, inner and outer concentric side surfaces 12, 14 respectively, and a bottom 16 which is integrally secured to the shank 4, e.g. by brazing or by integral molding as will be described.

Figure 2:
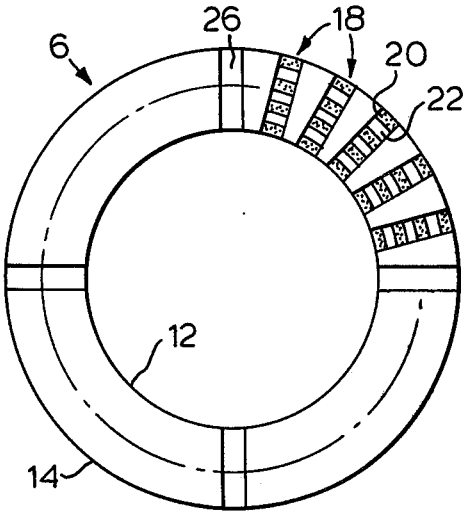
FIG. 2 is a top view of the bit of FIG. 1.

The crown 6 includes a number of circumferentially spaced composite segments 18. Each composite segment is formed, as also shown in FIG. 2, from a number of spaced parallel diamond impregnated segments 20 separated by a radial spacer material 22. The composite segments 18 extend generally radially between the inner and outer surfaces 12, 14 and also extend over a portion of the depth of the crown, from the cutting face 10 part way to the bottom 16. A diamond impregnated segment 20 is located at each end of each composite segment, as shown, to help maintain the gauge of the hole to be drilled by the bit. Additional diamond impregnated segments 21 are located at the inner and outer surfaces 12, 14, below each composite segment, to further help to maintain the gauge of the hole.

The composite segments 18 are separated circumferentially on the crown by a circumferential spacer material 24 which extends the full depth and thickness of the crown, except for conventional radial waterways 26 which are cut to permit passage of drilling fluid and drilling debris. The spacer material 24 is integrally bonded to the composite segments 20, as will be described, to hold and protect the composite segments as will be explained. The spacer material 24 also separates the gauge holding segments 21 both circumferentially and radially and is integrally bonded thereto.

It is an essential feature of the invention that the abrasion resistance of the diamond impregnated segments 20 is greater than that of the radial spacer material 22, and that the abrasion resistance of the radial spacer material 22 is in turn greater than that of the circumferential spacer material 24. Specifically, the abrasion resistance of the radial spacer material 22 must be less than that of the diamond impregnated segments 20, so that the radial spacer material 22 will wear more rapidly than segments 20 and thus will cause circular ribs of rings to be formed in the material being drilled. This effect, which is known, assists tracking of the bit (since the ribs act as a guide for the bit) and also improves the penetration rate, since the ribs in the formation being drilled tend to break off and are flushed away by the drilling fluid, without the need for consuming diamons to abrade the ribs. However, the abrasion resistance of the radial spacer material 22 must not be too much less than that of the diamond impregnated segments 20, since otherwise the diamond impregnated segments 20 will be prematurely exposed to an undue extent and will tend to break off, shortening the life of the bit.

The radial spacer material 22 must be of greater abrasion resistance than that of the circumferential spacer material 24, so that the material 24 will in turn wear away more rapidly than material 22. This ensures that the radially oriented edges of the composite segments 18 are adequately exposed for cutting and ensures that the material 24 will not interfere with the cutting action. The more rapid wear of material 24 can also provide very small area additional waterways between the composite segments 18 to improve the flushing away of drilling debris, further reducing wear on the bit. Again, however, the circumferential spacer material 24 must not wear too much more rapidly than the radial spacer material 22, to avoid premature exposure of the composite segments 18. If the composite segments 18 are prematurely exposed, the radial spacer material 22 will wear away too rapidly and the diamond impregnated segments 20 will tend to break or chip away, shortening the life of the bit. The material 24 ideally acts to buttress the composite segments 18, absorb shock protect them against breakage, and conduct heat away from them, particularly in the region of the cutting face 10.

Figure 3:
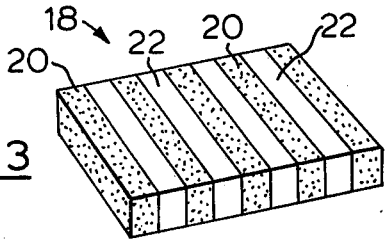
FIG. 3 is a perspective view of a composite segment which forms part of the drill bit of FIG. 1.
Figure 4:
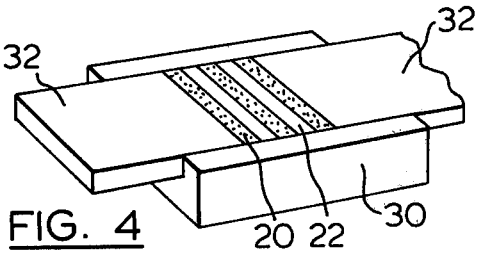
FIG. 4 is a diagrammatic perspective view illustrating the manufacture of the composite segment of FIG. 3.

In the preferred embodiment of the invention, the composite segments 18 are manufactured as a unit, as indicated in FIG. 3. As diagrammatically indicated, alternating layers of diamond impregnated material 20 and radial spacer material 22 are placed in a mold 30. Each layer as it is placed in position may be compressed by rams indicated at 32, the rams then being withdrawn and the next layer added. After the required number of layers has been placed in position, the resulting structure is then hot-pressed or sintered at an appropriate temperature (typically 1800° to 2000° F.) to form a composite segment 20. Heating of the material can be by a torch or furnace, or, normally, by electric induction heating. Normally a carbon plug will be placed on the top of the mold 30 during sintering to reduce the surface porosity of the upper face of the composite segment 20. Typically a very large composite segment is produced and is then cut into lengths to produce the required composite segments 20. The dimensions of the segments 20 and of the radial spacing between them may be varied depending on the nature of the ground being drilled; in one embodiment, however, the radial thickness of the segments 20 was about 0.062 inches, the circumferential dimension of the segments 20 was about 0.125 inches, and the radial spacing between them was about 0.005 inches.

As indicated, the materials from which the various portions of the crown are formed are important. Firstly, the matrix in which the diamonds are embedded to form the diamond impregnated segments 20 must satisfy several requirements. The matrix must have sufficient hardness so that the diamonds exposed at the cutting face 10 are not pushed into the matrix material under the very high pressures used in drilling. In addition, the matrix must have sufficient abrasion resistance so that the diamond particles are not prematurely released. In addition, the sintering or hot-pressing temperature for the matrix material for segments 20 must be sufficiently low (below about 2500° F.) that the diamonds are not graphitized during sintering or hot-pressing.

To satisfy these requirements, the following materials may be used for the matrix in which the diamonds are embedded: tungsten carbide, tungsten alloys such as tungsten/cobalt alloys, tungsten carbide or tungsten/-cobalt alloys in combination with elemental tungsten (all with an appropriate binder phase to facilitate bonding of particles and diamonds), and the matrices produced by Wall Colmonoy Corporation of Detroit, Mich. under its numbers 11 and 50. The number 50 material produced by Wall Colmonoy Corporation is an iron-bronze mixture containing 40%–60% iron-bronze, and the remainder a self-fluxing alloy consisting essentially of 70%–80% nickel and the remainder chromium, boron, silicon and iron. The material produced by Wall Colmonoy Corporation under its number 11 is fully described in Canadian Pat. No. 781,677 issued Apr. 2, 1968 to that company, and the disclosure of that patent is hereby incorporated by reference. One form of this matrix contains about 26% copper, 22% tungsten, 21.7% iron, 18% nickel, 4.4% chromium, 2.5% tin, 1.7% carbon, 1% boron, and 1.2% silicon. In general, the hardness on the Rockwall scale of the matrix in which the diamonds are embedded to form the segments 20 will be at least 100B, and probably at least 110B. The diamonds contained in the diamond impregnated segments 20 are present in a concentration of at least 75, and typically in a concentration of 100 or more. (A concentration of 100 is equivalent to 72 carats per cubic inch).

The radial spacer material 22 must, as indicated, wear at a greater rate than the diamond impregnated segments 20, but not at a rate so great as to prematurely expose the diamond impregnated segments 20. In addition, since the radial spacer material 22 is preferably hot-pressed or sintered in the same operation as segments 20, the same hot-pressing and sintering temperature limits are applicable. The radial spacer material 22 will therefore normally be the same material as the matrix used in the segments 20, but of course without the diamonds. Alternatively, material 14 may be a copper based material having a dispersion of secondary abrasives, such as tungsten carbide, to improve its abrasion resistance. In very special applications, where the ground being drilled has very low abrasion, steel shims may if desired be used.

The circumferential spacer material 24 must as indicated have less abrasion resistance than the radial spacer material 22, so that it will wear faster, but not so fast as to expose the composite segments 18 prematurely. The circumferential spacer material 24 must also have substantial thermal conductivity, so that it will act as a heat sink for the composite segments 18 (during drilling, the operating temperature of the crown can exceed 500° F.). In addition, the circumferential spacer material 24 should have a hot-pressing or sintering temperature low enough so that the diamonds in the composite segments are not degraded during the second heating required when the crown itself is fabricated. However, the hot-pressing or sintering temperature of material 24 should be high enough so that the material 24 is not weakened at the operating temperatures of about 500° F. In addition, the circumferential spacer material 24 should have sufficient ductility to absorb shocks and impacts during drilling.

It is found that copper based materials are highly suitable for use as the circumferential spacer material 24. For example, simple bronze may be used (85% copper, 15% tin). Nickel or aluminum based materials may also be used, so long as the hot-pressing or sintering temperature required is less than the melting temperature of any phase of materials 20 and 22 to a maximum of 2200° F. to prevent deterioration of the diamonds. Another suitable material for circumferential spacer material 24 is the material sold by Wall Colmonoy Corporation under its material number 7, but with some of the abrasive particles removed. This material normally consists of 50%–60% bronze, and the balance iron, except for 1%–5% chromium boride, which acts as an abrasive. For use as the circumferential spacer material 24, the proportion of chromium boride is held at a maximum of about 1%. Other secondary abrasives may be used in material 24, so long as the abrasion resistance is less than that of material 22, so that wear of material 24 is more rapid during drilling. This ensures that the material 24 does not interfere with the cutting action of the composite segments 18. The more rapid wear of material 24 under some conditions also helps provide a very small clearance between the segments 18 for passage of drilling fluid and drilling debris.

Figure 5:
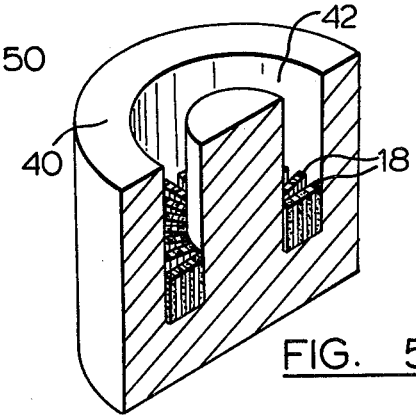
FIG. 5 is a perspective view, partly broken away, showing a mold used to produce the drill bit of FIG. 1.

In the fabrication of the complete crown, a conventional mold 40 may be used, as shown in FIG. 5. The mold cavity 42 is coated with a conventional release agent, then as shown, the composite segments 18 are placed on the mold cavity 42 with the desired circumferential spacing between them. The gauge holding segments 21 (not shown in FIG. 5) are next put in place. The circumferential spacer material 24 in powder form is next poured into the mold cavity 18 to fill the spaces between the segments 18 and to cover the segments 18 to the desired depth. The top of the shank 4 is then inserted into the mold cavity with appropriate sealer blocks (not shown) to seal the spaces between the top of the shank 4 and the edges of the mold cavity, and the whole is then sintered. When material 24 is largely bronze, the sintering may be carried out at a temperature of between 1500° F. and 1700° F., which is well below the temperature at which significant damage to the diamonds will occur. Normally the circumferential spacer material will have a sintering or hot-pressing temperature of at least 1000° F.

Figure 6:
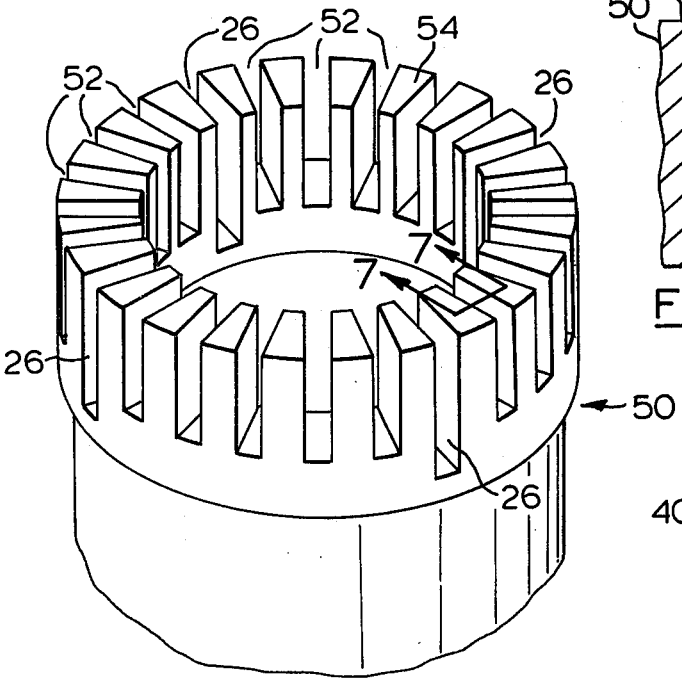
FIG. 6 is a perspective view illustrating a drill bit blank used in an alternative embodiment of the invention.
Figure 7:
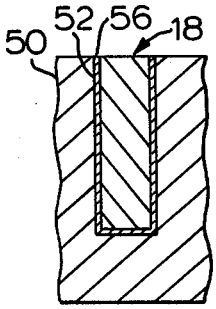
FIG. 7 is a cross-sectional view taken along lines 7—7 of FIG. 6 and showing a composite segment in position in the blank of FIG. 7 and ready to be brazed in position.

An alternative embodiment of the invention is illustrated in FIGS. 6 and 7. In this embodiment, the same composite segments 18 are used, but the shank and crown of the bit are now fabricated as a single unitary steel member 50. Slots 52 are cut in the cutting face 54 of the member 50, as shown in the blank illustrated in FIG. 6. The composite segments 18 are then brazed in position, as shown in FIG. 7, for example, by placing a thin sheet of copper 56 over the exterior of the segment 18 to act as a brazing material. In this case, the relatively high melting point of the steel member 50 is not a matter of concern, since although the composite segments are integrally secured to the member 50, no bulk melting of the member 50 is required. Ordinary mild steel may be used for the member 50.

The composite segments 18 may be oriented exactly radially, as shown, or they may be disposed slightly forwardly or rearedly of a radial plane. All such orientations may be considered as being generally radial.

Figure 8:
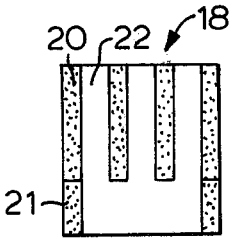
FIG. 8 is a side view of a modified segment for use in the invention.

The gauge holding segments 21, which help preserve the gauge of the hole being drilled until the segments 18 are entirely consumed, are usually heavily impregnated with diamonds at their outer surfaces only. However, some of the segments 21, at intermittent spacings circumferentially around the crown, are fully impregnated with diamonds to ensure that segments 18 can be fully consumed. The matrix material used on segments 21 is the same as that used in segments 20. In the FIG. 6 version of the invention, the gauge holding segments 21 and composite segments 20 may be formed integrally, with radial spacer material 22 located between the gauge holding segments 21, as shown in FIG. 8.

What I claim as my invention is:

1. A diamond drill core bit comprising:

a. an annular bit body having an end, b. an annular crown integrally secured to said end and having a cutting face and inner and outer concentric side surfaces, said crown comprising:

1. a plurality of composite segments each extending generally radially between said inner and outer side surfaces, said composite segments being spaced circumferentially from each other and being elongated depthwise of the crown and extending to said cutting face to wear with said cutting face in use, 2. a circumferential spacer material integrally adhered to said composite segments and extending circumferentially between said composite segments to space the latter circumferentially apart, said circumferential spacer material also extending generally radially between said inner and outer surfaces and being elongated depthwise of the crown and extending to said cutting face to wear with cutting face in use, c. each composite segment comprising a plurality of diamond impregnated segments separated radially from each other by a radial spacer material, a diamond impregnated segment being located at each of said inner and outer side surfaces, said diamond impregnated segments and said radial spacer material therebetween all extending to said cutting face, d. said diamond impregnated segments having greater abrasion resistance than that of said radial spacer material such that said radial spacer material will wear at a controlled rate which is greater than that of said diamond impregnated segments but not so great as to prematurely expose said diamond impregnated segments, e. said radial spacer material having greater abrasion resistance than that of said circumferential spacer material such that said circumferential spacer material will wear at a controlled rate which is greater than that of said radial spacer material, but is not so great as to prematurely expose said composite segments, f. said circumferential spacer material having substantial thermal conductivity and ductility.

2. A bit according to claim 1 wherein said circumferential spacer material is steel, said crown being formed by forming radial slots in said circumferential spacer material, inserting said composite segments in said slots, and then brazing said composite segments in said slots.

3. A bit according to claim 1 wherein said circumferential spacer material has a sintering temperature greater than 1000° F. and less than 2200° F.

4. A bit according to claim 3 wherein said diamond impregnated segments comprise a matrix material with diamonds mixed therein in a concentration of at least 75, said matrix material and said radial spacer material having substantially the same sintering temperature, said matrix material having a Rockwall hardness of at least 100B.

5. A bit according to claim 4 wherein said diamond impregnated segments and said radial spacer segments are formed together in a single molding operation to form said composite segments.

6. A bit according to claim 3 wherein said matrix is selected from the group of materials which consists essentially of tungsten, tungsten/cobalt alloys, and tungsten carbide in substantial portion, said radial spacer material is essentially the same material as said matrix, and said circumferential spacer material includes a substantial proportion of copper.

* * * * *